US006092870A

United States Patent [19]

Desnoyers et al.

[11] Patent Number: 6,092,870

[45] Date of Patent: Jul. 25, 2000

[54] ROCKING AND GLIDING MECHANISM FOR FURNITURE

[75] Inventors: Charles Desnoyers, St-Pie; Pierre Bellefleur, Magog, both of Canada

[73] Assignee: Dutailier International Inc., St-Pie, Canada

[21] Appl. No.: 09/199,514

[22] Filed: Nov. 25, 1998

[30] Foreign Application Priority Data

Mar. 9, 1998 [CA] Canada ..... 2231701

[51] Int. Cl.[7] ..... A47C 3/02

[52] U.S. Cl. ..... 297/281; 297/273; 248/370

[58] Field of Search ..... 297/273, 281, 297/282, 258.1; 248/370; 5/108, 127

[56] References Cited

U.S. PATENT DOCUMENTS

| | | | |
|---|---|---|---|
| 4,108,415 | 8/1978 | Hauray et al. | 248/370 |
| 4,169,625 | 10/1979 | Peterson | 297/344.26 |
| 4,544,201 | 10/1985 | Rogers, Jr. | 297/271 |
| 4,615,059 | 10/1986 | Darowski | 5/108 |
| 5,024,483 | 6/1991 | Kammam | 297/273 |
| 5,344,214 | 9/1994 | Trent | 297/273 X |
| 5,427,433 | 6/1995 | Holobaugh, Jr. | 297/273 |
| 5,635,505 | 6/1997 | Holobaugh, Jr. | 297/273 |
| 5,636,898 | 6/1997 | Dixon et al. | 297/316 |

FOREIGN PATENT DOCUMENTS

| | | | |
|---|---|---|---|
| 2451727 | 11/1980 | France | 297/282 |

*Primary Examiner*—Peter R. Brown
*Attorney, Agent, or Firm*—Ladas & Parry

[57] ABSTRACT

A rocking mechanism for mounting a piece of furniture, such as a chair, sofa or cradle, on a support arrangement, the rocking mechanism allowing the piece of furniture to rock relative to the support arrangement. The mechanism comprises a unitary front link, a unitary rear link and first and second lower links. The unitary front link has an upper end adapted to be pivotally mounted to the support and a lower end that defines an elongated bottom front bearing member. The unitary rear link has an upper end adapted to be pivotally mounted to the support arrangement and a lower end that defines an elongated bottom rear bearing member. Each of the lower links has a front end and a rear end. The front ends of the first and second lower links are pivotally mounted to the bottom front bearing member about a pivot axis that extends along the bottom front bearing member, where the bottom front bearing member extends substantially continuously from the front end of the first lower link to the front end of the second lower link. Any type of furniture, for instance a seat, a chair, a sofa or the like may be mounted on top of the rocking mechanism. Variants with a sofa, a baby bed, a cradle or a footrest may also be provided.

26 Claims, 10 Drawing Sheets

ROCKING AND GLIDING MECHANISM FOR FURNITURE

FIELD OF THE INVENTION

This invention relates to a new or improved mechanism for providing free rocking and gliding movement to a seat, a chair, any other seating arrangement or any other type of furniture. The invention also relates to furniture that incorporates such mechanism.

BACKGROUND OF THE INVENTION

Simple rocking chairs have been known since time immemorial, and in more recent decades various chair configurations have been available having mechanisms that accommodate rocking movements of the chair against the force of a return spring, often in combination with a swivel arrangement Chairs have also been developed which accommodate a gliding movement and a rocking movement as well as combinations of these two movements. One example of such chair is shown in U.S. Pat. No. 4,108,415 Hauray et al U.S. Pat. Nos. 5,427,433 and 5,653,505 Holobaugh disclose upholstered armchairs that combine a rocking/gliding mechanism together with a swivel base. The prior art rocking/gliding mechanisms tend to be configured as four-bar linkages on opposite sides of the chair, there being two downwardly oriented links laterally spaced at the front of the chair and two downwardly oriented links laterally spaced towards the rear of the chair. These known mechanisms tend to be very utilitarian and unsightly in appearance, and in the Holobaugh patents for example are completely hidden on the underside of the chair Such a mechanism may also be subject to premature wear.

Thus, there is a need in the industry for an improved rocking and gliding mechanism for furniture.

OBJECTS AND STATEMENT OF THE INVENTION

It is an object of the invention to provide a rocking mechanism avoiding the above mentioned drawbacks.

It is an object of the invention to provide a rocking mechanism of simple and reliable construction.

It is another object of the invention to provide a rocking mechanism providing reduced wear, in particular in the bearings.

As embodied and broadly described herein, the invention provides a rocking mechanism for mounting a piece of furniture on a support arrangement and for rocking relative to the support arrangement, mechanism comprising a unitary front link having an upper end adapted to be pivotally mounted to the support arrangement and having a lower end that defines a bottom front bearing member, a unitary rear link having an upper end adapted to be pivotally mounted to the support arrangement and having a lower end that defines a bottom rear bearing member and first and second lower links, each of the lower links having a front end and a rear end respectively, the front ends of the first and second lower links being pivotally mounted to the bottom front bearing member about a pivot axis that extends along the bottom front bearing member, where the bottom front bearing member extends continuously from the front end of the first lower link to the front end of the second lower link.

Advantageously, each of the unitary front and rear links comprises at each end a bearing tube in which a pair of bearing axles are pivotally mounted, each of the bearing axles extending outwardly from a respective end of the bearing tube to provide first and second bearing supports for connection to the first and second lower links.

Advantageously, the upper and lower bearing tubes are linked with at least one bridge member.

In a variant, the upper bearing tube is adapted to be pivotally connected to the support arrangement.

In another variant, the upper bearing supports are adapted to be pivotally connected to the support arrangement.

In a variant, the lower bearing tube is adapted to be pivotally connected to the lower links.

In another variants the lower bearing supports are adapted to be pivotally connected to the lower links.

As embodied and broadly described herein, the invention also provides a piece of furniture comprising a rocking and gliding mechanism as defined herein above, a support arrangement, and an adapter member

BRIEF DESCRIPTION OF THE DRAWINGS

A detailed description of the preferred embodiments of the present invention is provided herein below, by way of example only, with reference to the accompanying drawings, in which.

Figure 1:
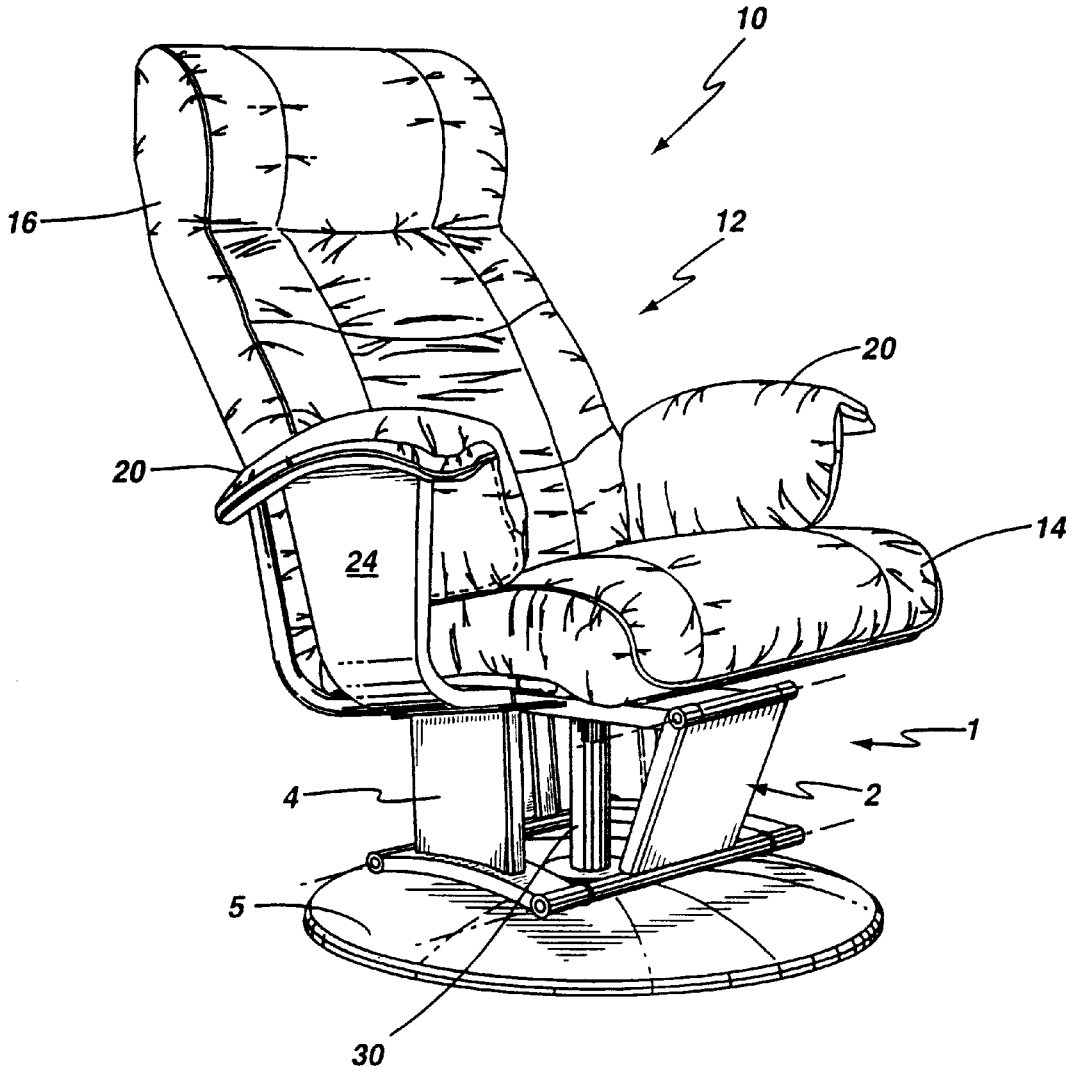
FIG. 1 is a front perspective view of a preferred embodiment of a piece of furniture provided with a rocking mechanism in accordance with the present invention.

In the drawings, preferred embodiments of the invention are illustrated by way of examples. It is to be expressly understood that the description and drawings are only for the purpose of illustration and are an aid for understanding. They are not intended to be a definition of the limits of the invention.

DESCRIPTION OF THE PREFERRED EMBODIMENT

Figure 3A:
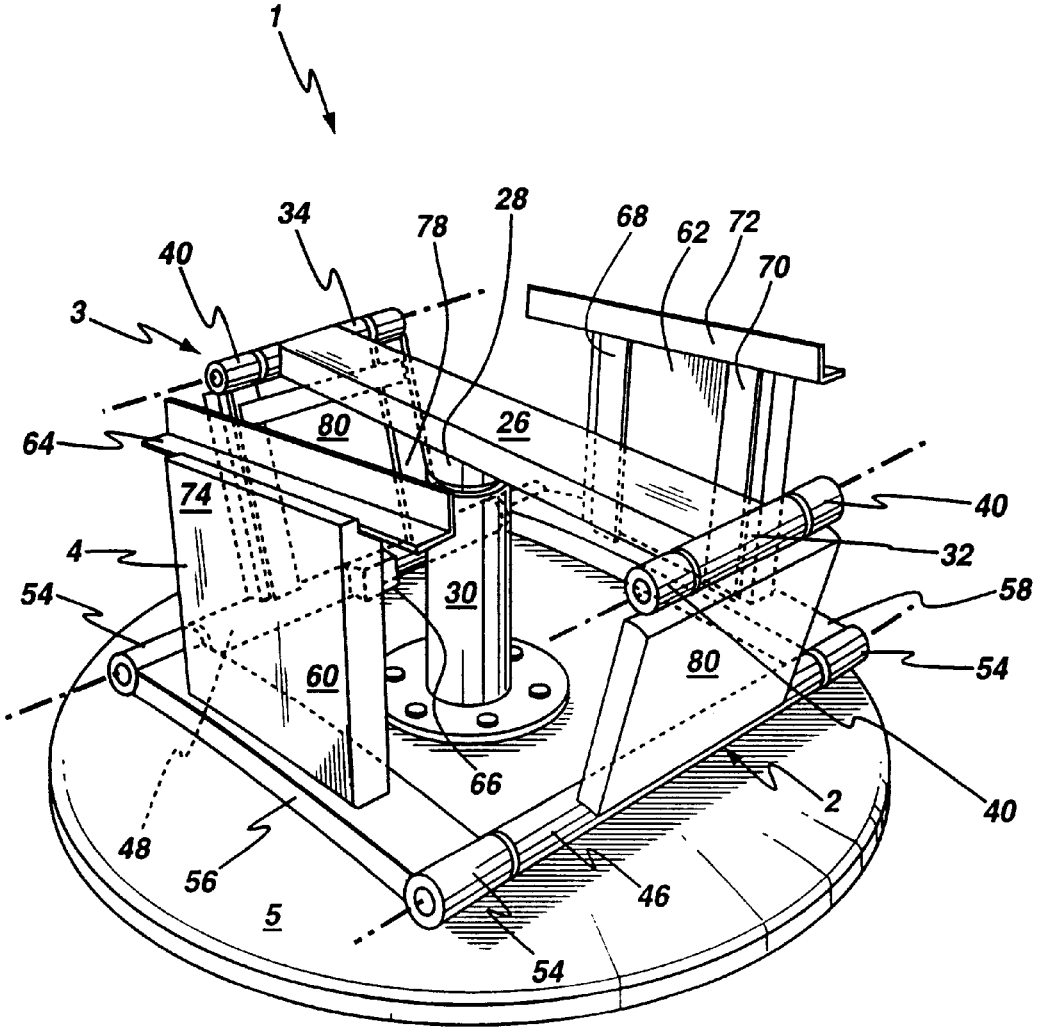
FIGS. 3A, 3B and 3C are perspective views showing the mechanism and an example of support.
Figure 3B:
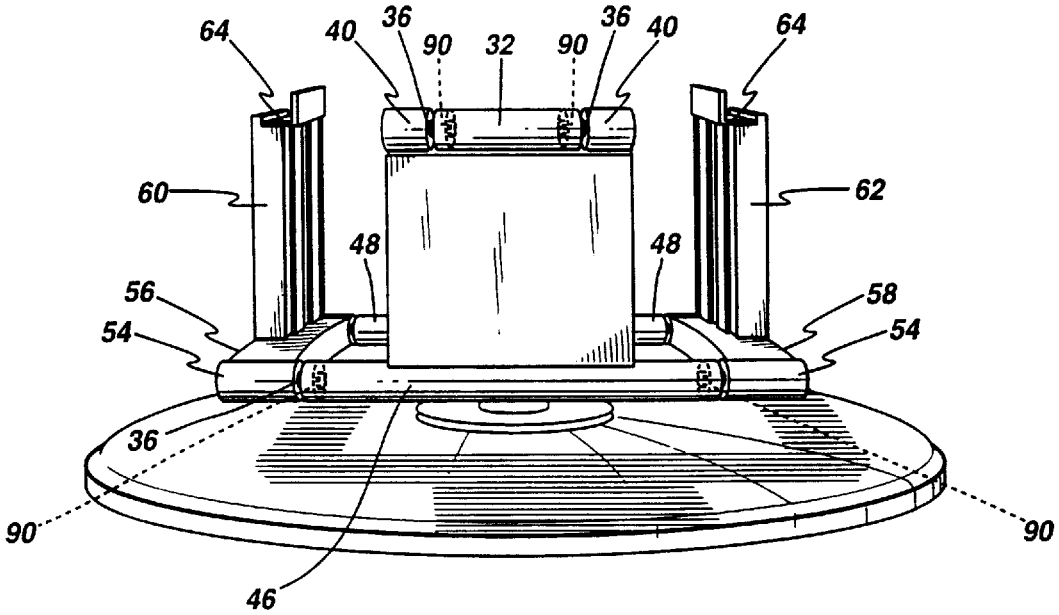
Figure 3C:
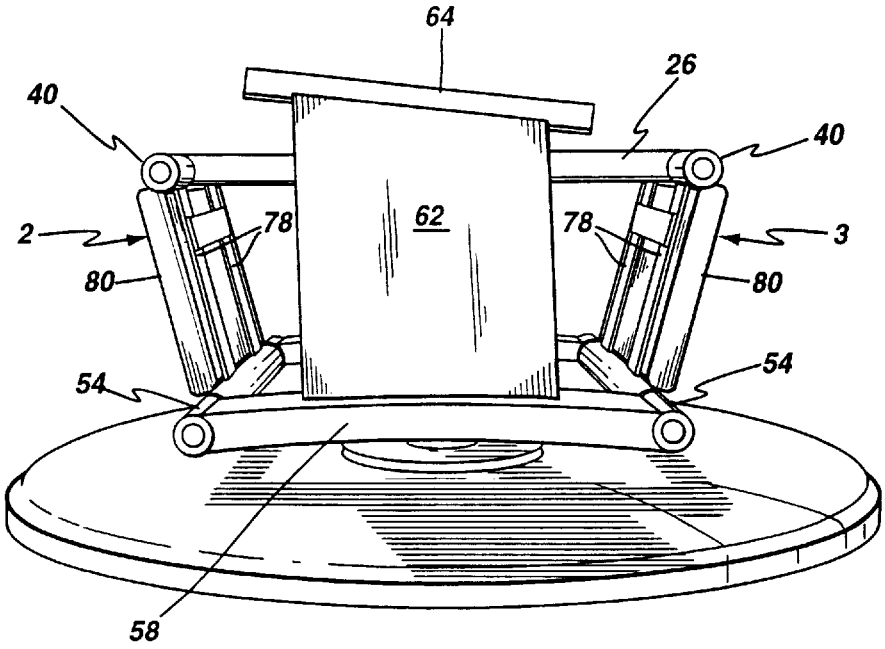

FIG. 1 illustrates an example of an embodiment of a chair comprising a rocking mechanism according to the invention. Referring to this figure and to FIGS. 3A, 3B and 3C there is shown a piece of furniture 10, for example an upholstered chair provided with a rocking mechanism 1 according to the invention, a seating part 12 comprising a generally horizontal seat 14 and a backrest 16. A support arrangement 5, for example as illustrated in FIGS. 1 and 3 of large diameter circular form having a convex upper surface is provided to support the rocking mechanism. At each side of the seat 14 is an upwardly extending armrest 20. The seat is carried on a seating platform 22 at each side of which is an outwardly and upwardly extending wing 24 which provides a support for the corresponding armrest 20. In accordance with the invention, any type of furniture, for instance a seating arrangement such as a chair or sofa or the like may be used to place on top of the rocking mechanism. Variants with a sofa, a baby bed, a cradle or a footrest may also be provided In this embodiment, the support comprises a substantially vertical post 30, advantageously provided with a swivel mounting 28 on top of which a spreader frame 26 is provided In the embodiment illustrated in FIG. 1, the spreader frame 26 is a hollow rectangular steel member, and as seen more particularly in FIGS. 3A, 3B and 3C extends horizontally above the post 30 having connections to the front and rear links 2, 3. For example, the spreader frame may be welded at each opposite ends to a front bearing outer member or bearing tube 32 and a rear bearing outer member or bearing tube 34. As is clearly shown in FIG. 3A, the horizontal spacings between the bearing tubes 32, 34 and the post 30 are advantageously unequal, the rear bearing tube 34 being much closer to the post 30 than the front bearing tube 32. Each bearing tube 34 extends horizontally transversely to the length of the spreader frame 26 and forms a bearing support for bearings 90 provided at each extremity thereof. Bearing axles 36 are connected to the inner portion of the bearings 90 and extend outwardly to form bearings supports 40 (FIG. 3B).

The lower ends of the front and rear links 2, 3 have attached thereto elongate horizontal bearing members, such as bearing tubes 46, 48, each of which extends laterally beyond the sides of the respective unitary link and supports corresponding bearings 90 Bearing axles 36 are connected to bearing supports 54, as previously described for the upper bearing tubes. A pair of lower supports links 56, 58 is provided. Each lower support link extends between the bearing supports 54.

Each support link is preferably of hollow steel box section, the bearing supports 54 being integrally attached as by welding to the front and rear ends of the support links 56 and 58, and these support links having an upwardly convex curvature along their length as indicated in FIG. 3A to reflect the convex curvature of the top of the support 5.

Each of the support links 56, 58 supports adapter members 4, interfacing between the rocking and gliding mechanism and the piece of furniture. In the illustrated example, the lower end of upstanding side frames 60, 62 are connected to the lower support links 56, 58 The upper ends of the side frames are preferably at an angle to the horizontal sloping slightly upwardly in the forwards direction and having projecting mounting plates 64 thereon for attachment to the seating platform 22 by means of threaded fasteners (not shown).

Figure 2A:
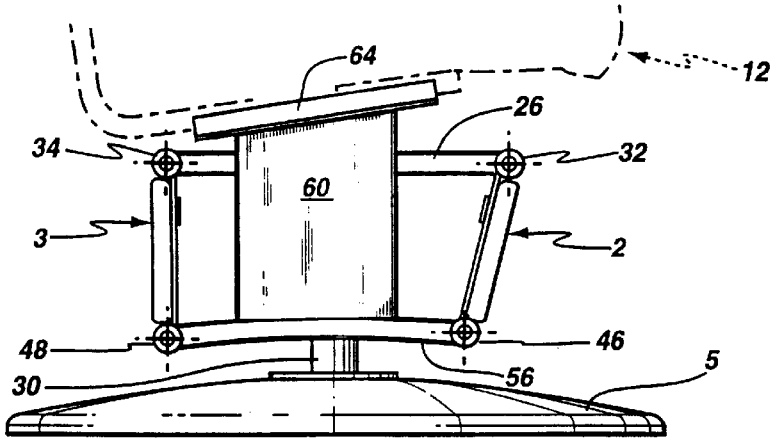
FIGS. 2A, 2B and 2C are schematic views illustrating the rocking action afforded by the rocking mechanism.
Figure 2B:
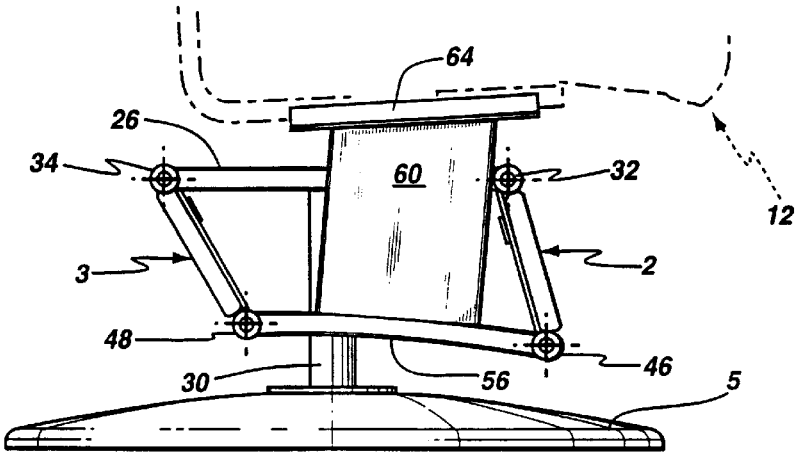
Figure 2C:
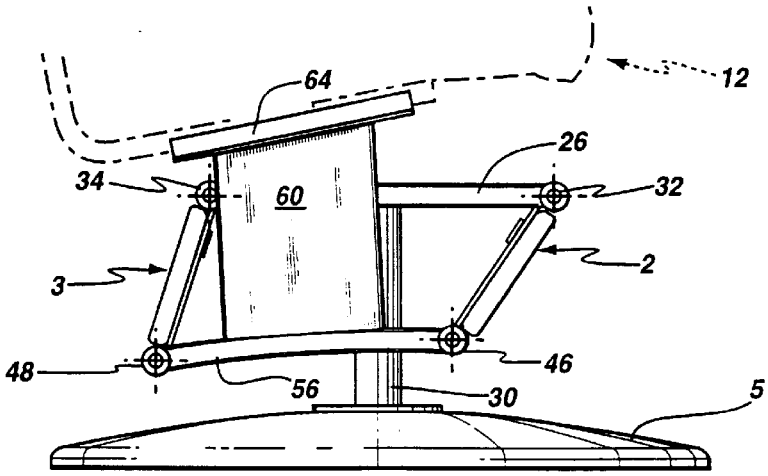

The front and rear links 2, 3 are of equal length and converge downwardly since the lower support links 56, 58 are shorter than the spreader frame 26. Thus the seat 12 that is supported through the platform 22 and the mounting plate 64 on the side frames 60, 62 is movable in a rocking and gliding motion with respect to the support 5. This motion is illustrated in FIGS. 2A, 2B and 2C, in which views, the front of the chair faces to the right. FIG. 2A shows the neutral position assumed by the linkage when the mechanism is at rest. When the mechanism is rocked forwardly, the linkage assumes the position indicated in FIG. 2B, wherein the lower support links 58, 56 are forwardly displaced, this being accommodated by counter-clockwise pivotal movement of the front and rear links 2,3 about their respective bearing axles 36, 38. On the other hand when the mechanism is rocked rearwardly, the linkage is displaced as shown in FIG. 2C.

As has been noted above, the spreader frame 26 is advantageously not centrally mounted on the post 30, but rather is offset forwardly thereon so that in the rest position as seen in FIG. 2A, the tube 48 is spaced further from the vertical post 30 than is the tube 46. Forward rocking movement as illustrated in FIG. 2B is limited by abutment of the rear bearing tube 48 against the post 30, and to cushion any impact a resilient bumper pad 66 (FIG. 3A) is advantageously carried centrally on the front side of the rear bearing tube 48.

Suitable bearings 90 such as nylon bushings or ball bearings are interposed between the bearing axles 36 and the bearing outer member 32, 34, 46, 48 to provide a smooth pivot action so that the rocking and gliding mechanism can be rocked and glided with an exceptionally smooth action.

The structures of the front and rear links 2, 3 and of the adapter member 4 are provided as metal fabrications, as is best seen in FIG. 3A. As seen here, the side frame 62 comprises two vertical metal straps 68, 70, the lower ends of which are welded to the lower support link 60 and the upper ends of which are welded to an inclined metal strip 72 the ends of which constitute the mounting plates 64. A decorative outer panel 74 is attached to the metal straps 68, 70 by screws The side frame 60 is of similar construction.

Likewise the front and rear links 2, 3 are preferably of welded metal fabrication, the front link comprising a pair of bridge members 78 the lower ends of which are welded to the lower bearing tube 46 and the upper ends of which have welded thereto the bearing supports 40. A decorative panel 80 is attached to the bridge members 78 by screws and forms a unitary structure therewith. The rear link 3 is of similar construction to the front link The decorative panels 74, 80 can be of any desired finish. In the example illustrated these panels and the upper side of the base 11 are of wood and are all finished with a rich wood grain appearance.

It will be apparent to the skilled person in the art that many variations or modifications are possible within the scope of the invention For instance, others materials such as wood or composites may be used. The bearings may be disposed in or connected to the bearing supports.

Figure 4:
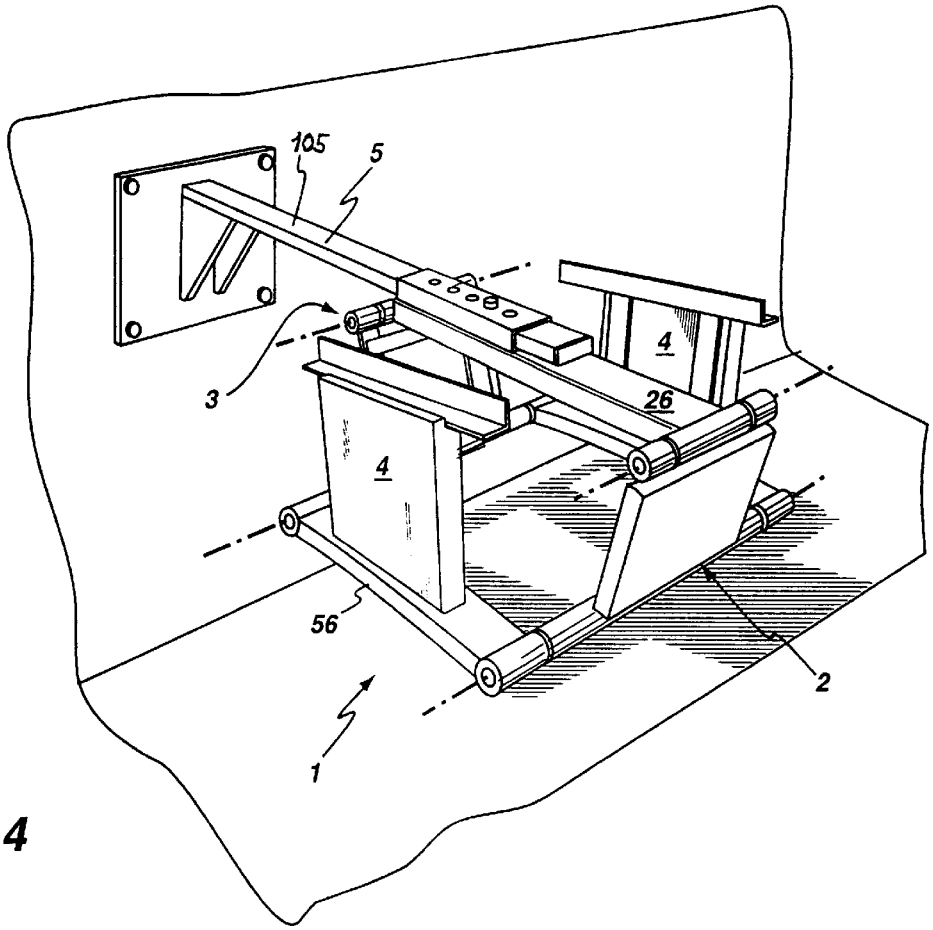
FIGS. 4 and 5 are top perspective views illustrating variants of the rocking mechanism of the present invention.

Other embodiments are illustrated in FIGS. 4 to 12. In FIG. 4, a different support arrangement is illustrated A rod member 105, adapted for connection to a wall, is provided. It is advantageously of adjustable length, to adjust the final position of the furniture with respect to the wall. The support extends longitudinally from the connection point to the rear link 3 and to the front link 2, for attachment of the links thereto. Thus, its extremity forms the spreader member 26. Such a support allows to free the inner and lower portions of the mechanism. This provides easy cleaning of the floor. The enhanced stability due to the attachment to the adjacent wall may also be advantageous.

Figure 5:
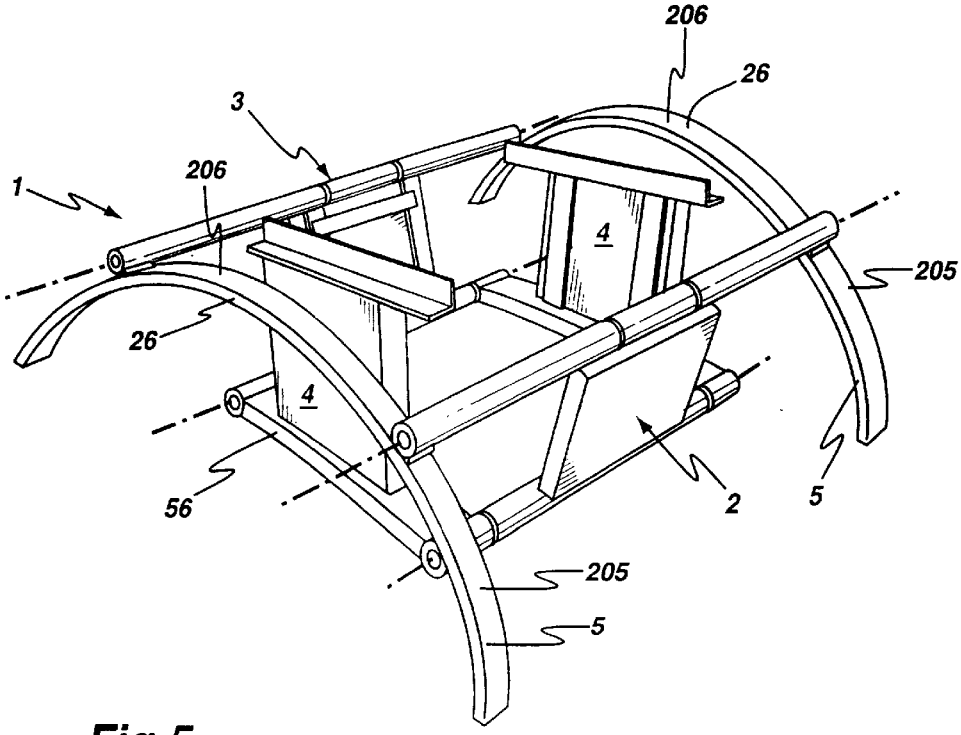

FIG. 5 illustrates an embodiment with a support arrangement provided with a set of arched-type feet Each reversed U-shaped foot 205 extends laterally from the rear lower portion to the front lower portion of the mechanism. The front and rear links 2 and 3 are connected to the raised central portion 206 of each foot. This portions forms a spreader member 26. Such an arrangement also frees the inner portion of the mechanism.

Figure 6:
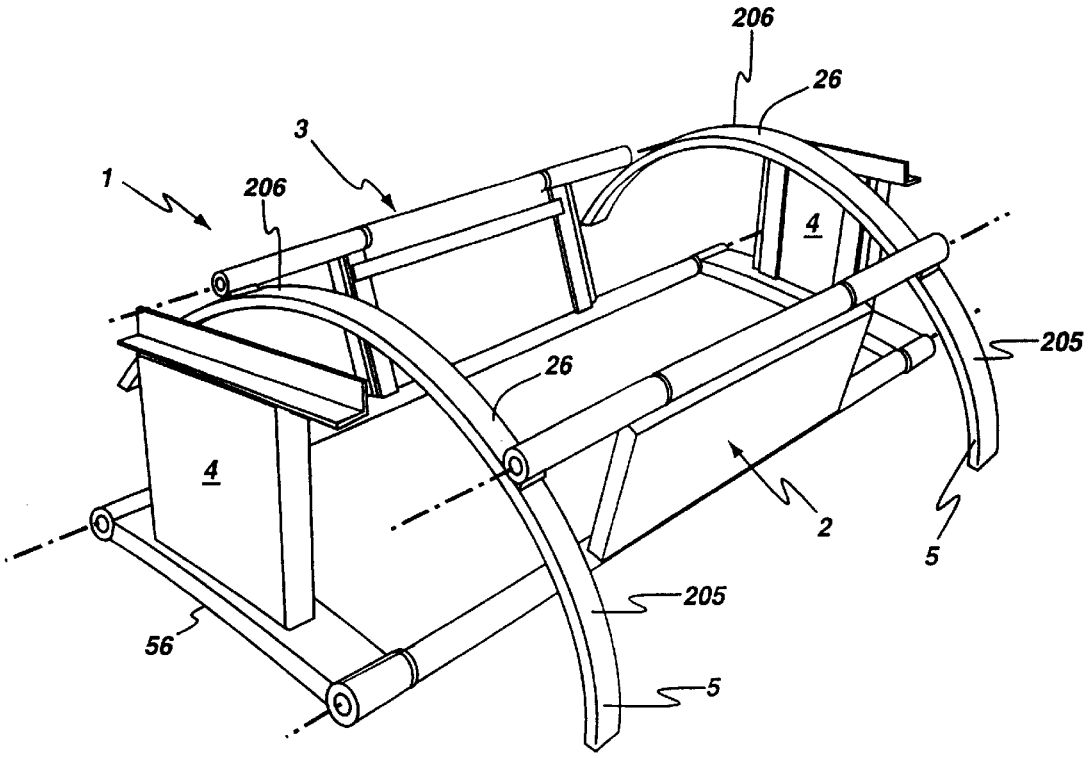
FIGS. 6 and 7 are top perspective views illustrating other embodiments of the rocking mechanism of the present invention with outer adapter members.

FIG. 6 illustrates a variant of the embodiment of FIG. 5 with enlarged front and rear links, so that the adapters are provided outside the support arrangement This variant is particularly advantageous to adapt large furniture such as a sofa or a baby bed, etc. In FIG. 6, the front and rear links are wider than those of the preceding embodiments. This may be achieved with longer tubes and/or support.

Figure 7:
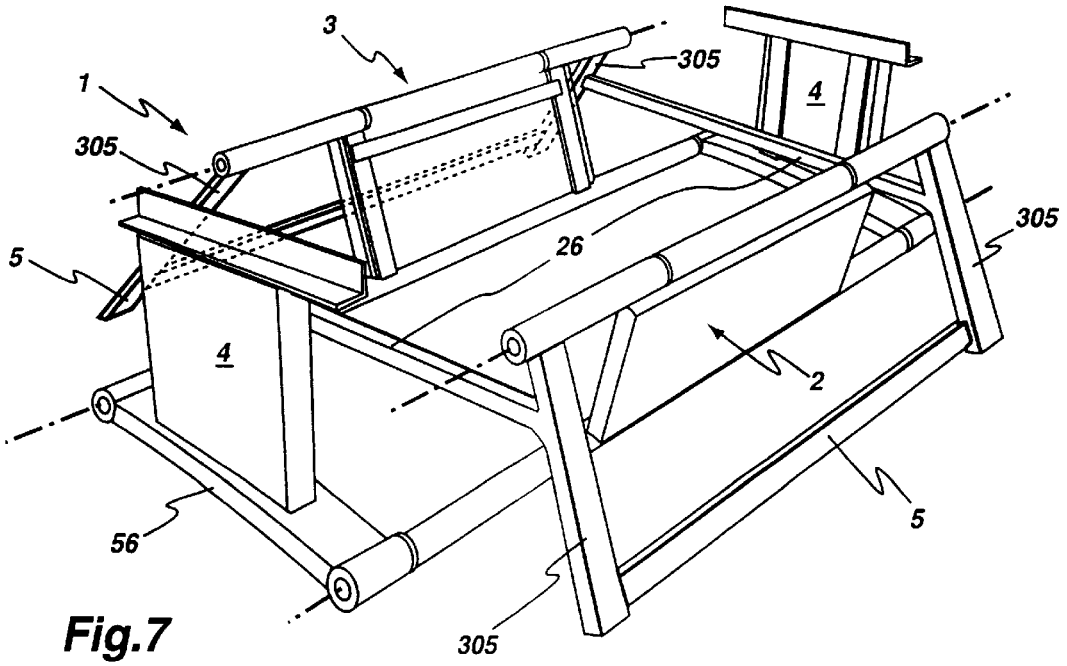

FIG. 7 illustrates an embodiment with a support arrangement disposed longitudinally. The support arrangement comprises a set of feet 305. The front foot is connected to the top portion of the front link 2, for instance to the supports. In the normal position, the feet extend downwardly to the ground surface. The front and rear feet are advantageously connected to each other with the spreader member 26, as shown in FIG. 7. Thus, the spreader member 26 connects the front and rear links 2 and 3. The rear support is of similar construction.

Figure 8:
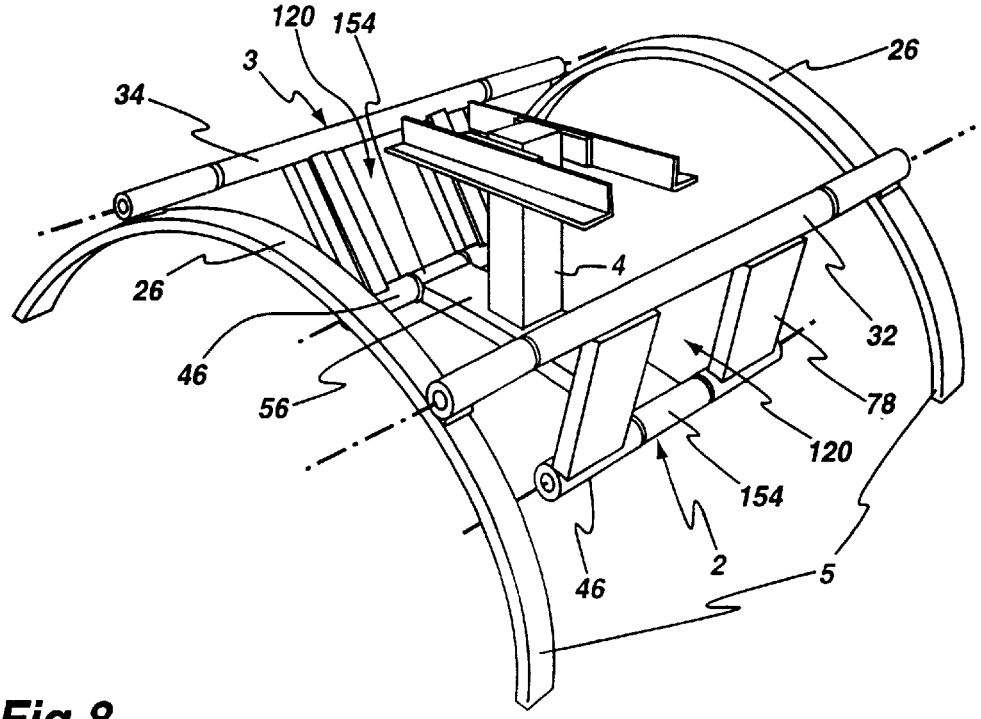
FIG. 8 is a top perspective view illustrating a variant of the rocking mechanism of the present invention with outer adapter members and T-shaped support members.

FIG. 8 illustrates a variant of the embodiment illustrated in FIG. 6, with a T-shaped support. It preferably comprises two spaced apart T-shaped members 405 having a lower extremity adapted to be supported by the ground surface, and two upper extremities, forming spreader members 26, extending laterally and adapted for connection with the front and rear links.

Figure 9:
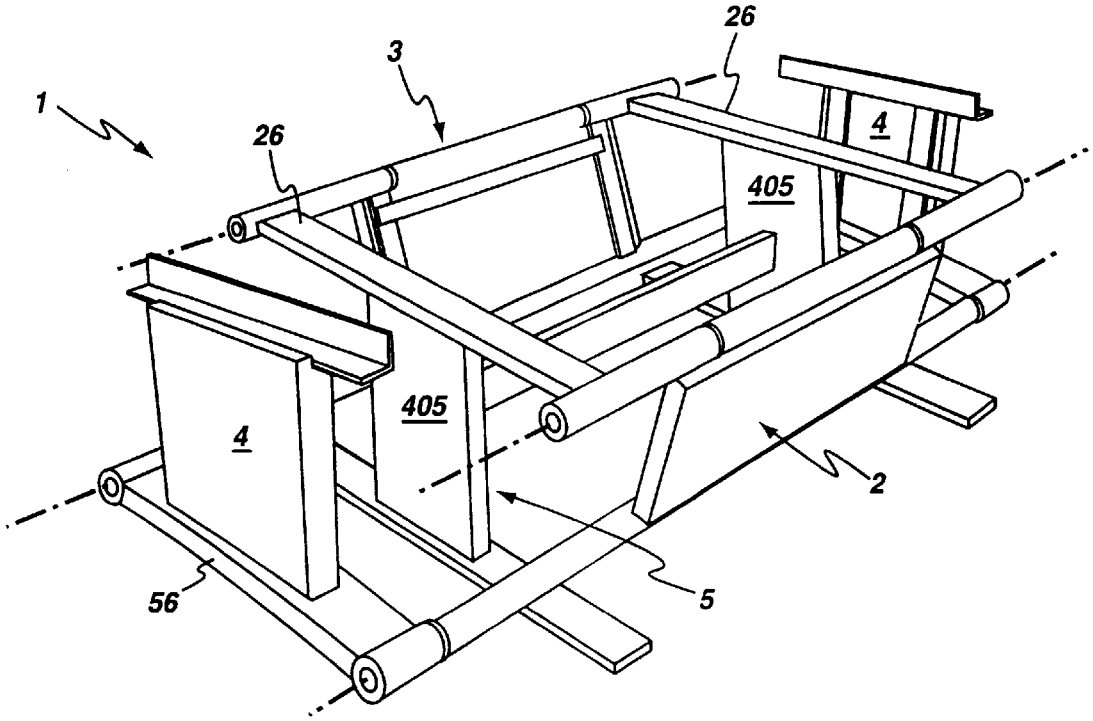
FIG. 9 is a top perspective view illustrating another embodiment of the rocking mechanism of the present invention with substantially central knuckles.

FIG. 9 illustrates another embodiment similar in many aspects to the one shown in FIG. 6. The support arrangement and its connection with the front and rear links is similar. However, the front and rear links each comprises a substantially central knuckle 154. The dual bridge members 78 are on one side connected to the front and rear bearing tubes 32 and 34 and on the other side to the outer portions of the lower bearing tubes 46 and 48. Openings 120 are defined between these elements. A lower support link 56 is connected to each knuckle and forms a substantially central basis to support the adapter member 4 The furniture may be placed on top of the adapter 4.

Figure 10:
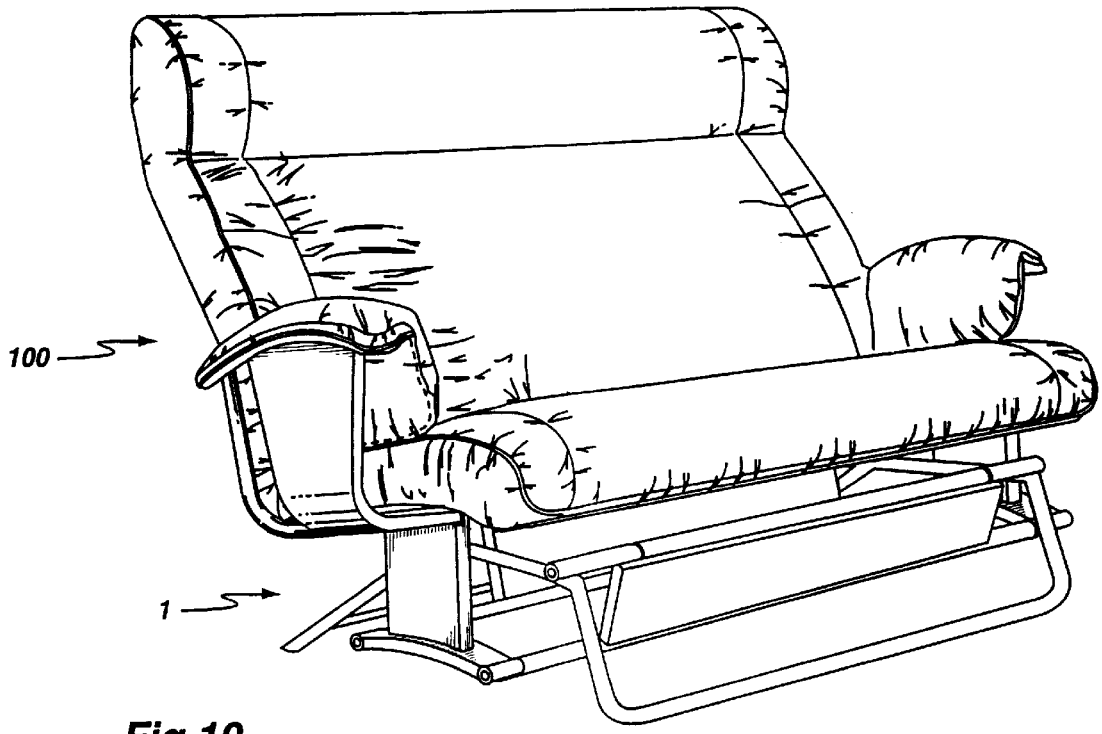
FIGS. 10 to 13 are top perspective views illustrating examples of furniture provided with the rocking mechanism of the present invention.
Figure 11:
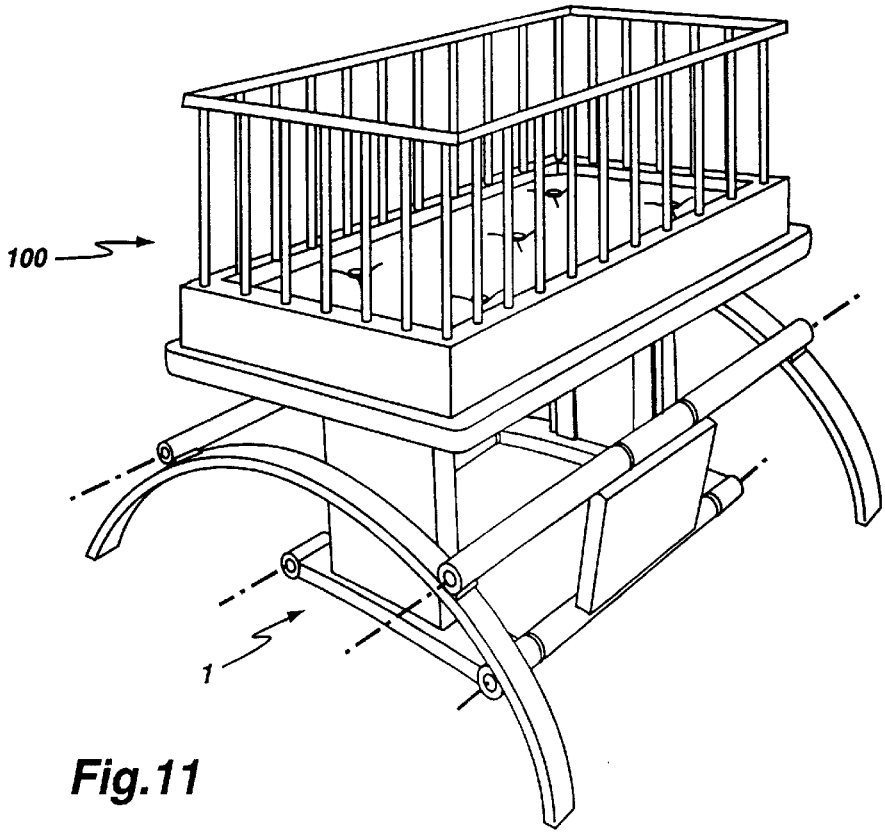
Figure 12:
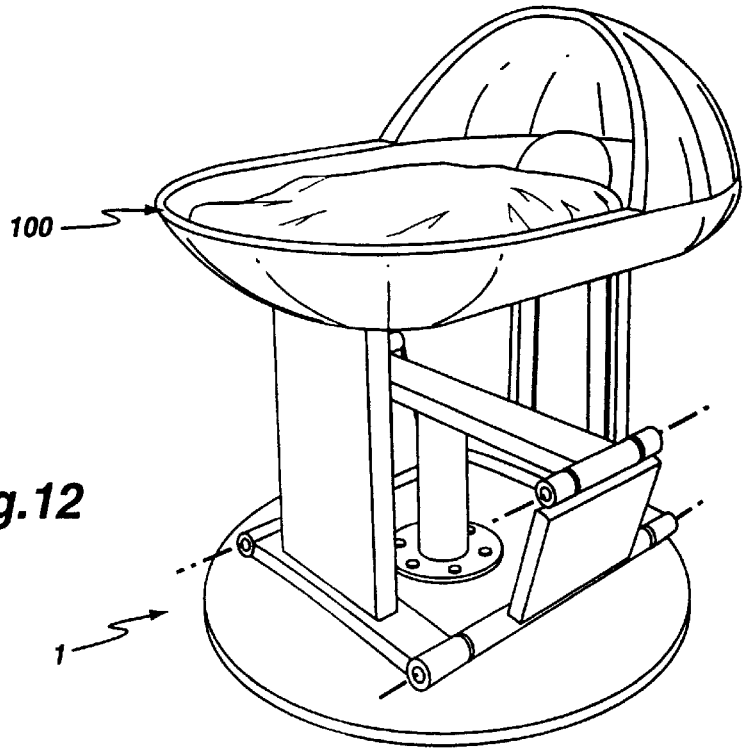
Figure 13:
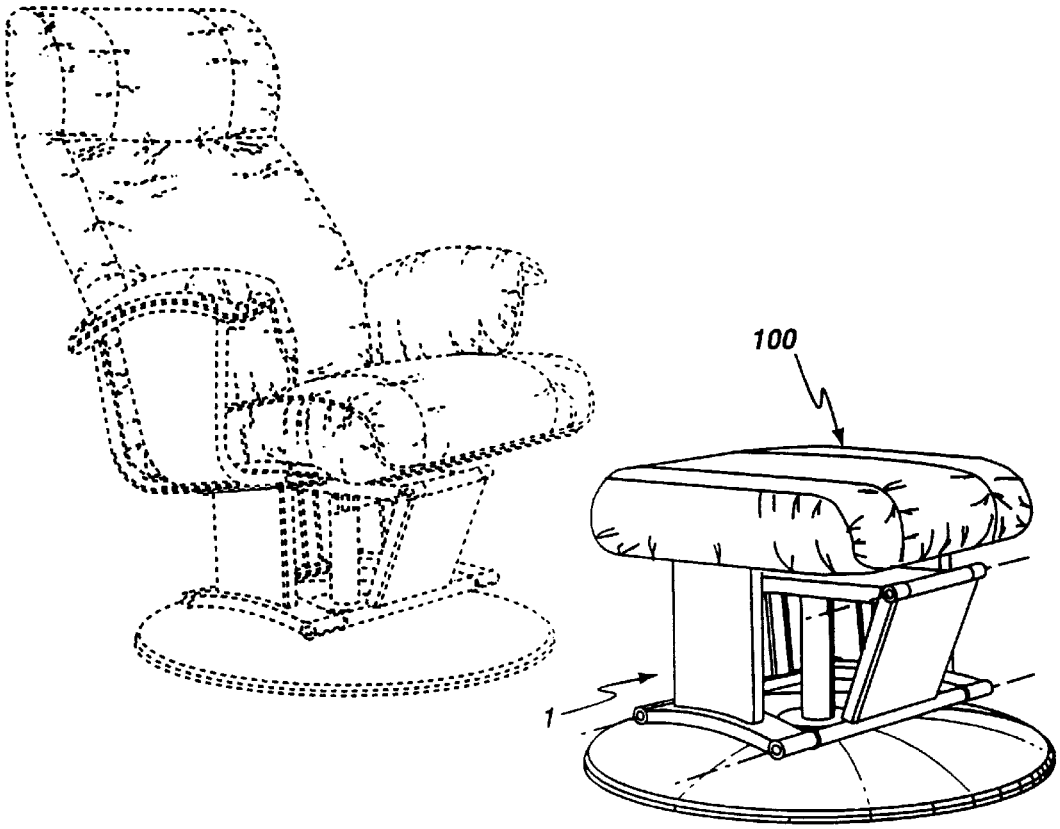
Figure 14:
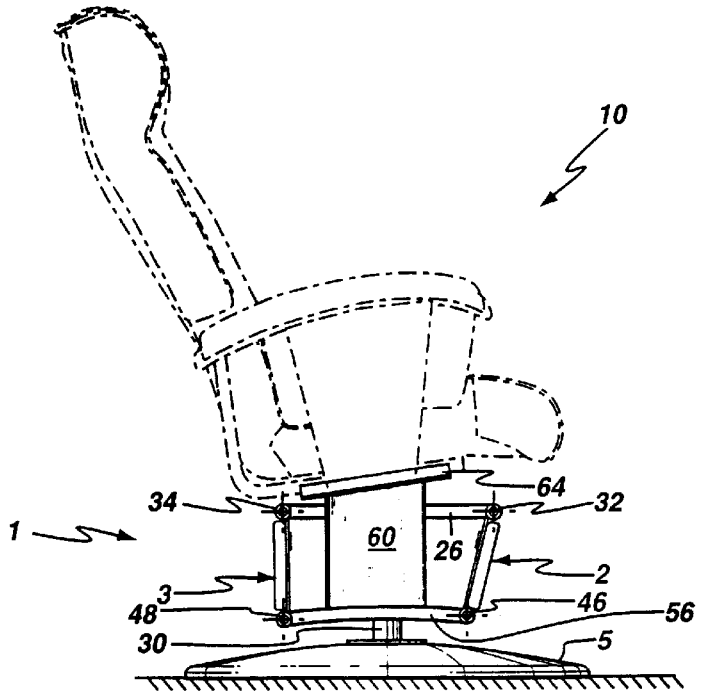
FIGS. 14 and 15 are respectively side and front elevational views of a seat provided with the rocking mechanism of the present invention.
Figure 15:
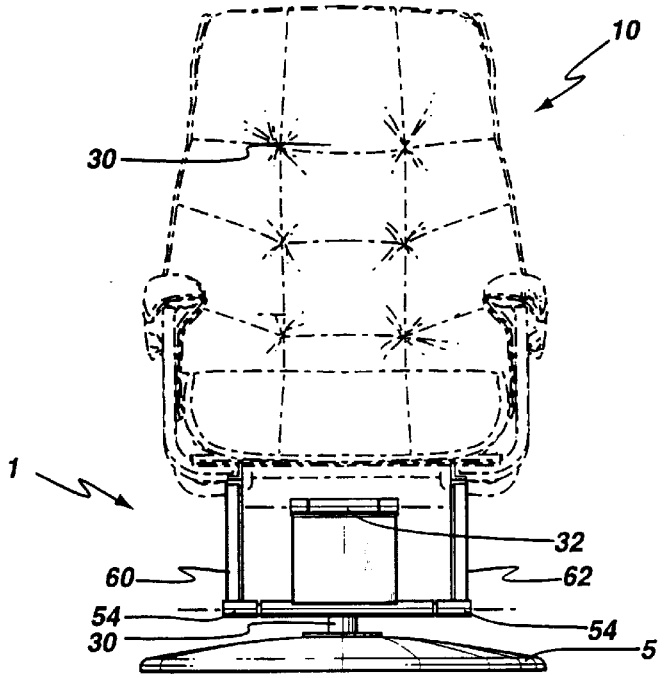

FIGS. 10 to 13 illustrate examples of furniture 100 provided with the rocking mechanism of the invention FIG. 10 illustrates a sofa, FIG. 11 shows a baby bed, FIG. 12 illustrates a cradle, and FIG. 13 a footrest. Other types of furniture may of course be provided without departing from the spirit and scope of the invention.

The above description of preferred embodiments should not be interpreted in a limiting manner since other variations, modifications and refinements are possible within the spirit and scope of the present invention. The scope of the invention is defined in the appended claims and their equivalents.

What is claimed is:

1. A rocking mechanism for mounting a piece of furniture on a support arrangement, said rocking mechanism allowing the piece of furniture to rock relative to the support arrangement, said rocking mechanism comprising:

a unitary front link having an upper end adapted to be pivotally mounted to the support arrangement and having a lower end that defines an elongated bottom front bearing member;

a unitary rear link having an upper end adapted to be pivotally mounted to the support arrangement and having a lower end that defines an elongated bottom rear bearing member; and first and second lower links, each of said lower links having a front end and a rear end respectively, the front end of said first lower link and the front end of said second lower link being pivotally mounted to said bottom front bearing member about a pivot axis that extends along said front bearing member, said bottom front bearing member extending substantially continuously from the front end of said first lower link to the front end of said second lower link.

2. A rocking mechanism as defined in claim 1, wherein said bottom front bearing member has a longitudinal axis coincident with said pivot axis.

3. A rocking mechanism as defined in claim 2, wherein said bottom front bearing member comprises a pair of bearing axles, said bearing axles projecting from respective ends of said bottom front bearing member and penetrating the respective front ends of said first and second lower links.

4. A rocking mechanism as defined in claim 3, wherein the rear end of said first link and the rear end of said second link are pivotally mounted to said bottom rear bearing member about a pivot axis that extends along said bottom rear bearing member, said bottom rear bearing member extending substantially continuously from the rear end of said first lower link to the rear end of said second lower link.

5. A rocking mechanism as defined in claim 4, wherein said bottom rear bearing member comprises a pair of bearing axles, said bearing axles projecting from respective ends of said bottom rear bearing member and penetrating the respective rear ends of said first and second lower links.

6. A rocking mechanism as defined in claim 1, wherein each of said unitary front and rear links comprises at least one decorative panel attached thereto.

7. A rocking mechanism as defined in claim 1, wherein each of said first and second lower links is upwardly convex along its length.

8. A rocking mechanism as defined in claim 1, wherein each of said first and second lower links is operative to support a side frame mounted thereon, each of said side frames having an upper end and a lower end.

9. A rocking mechanism as defined in claim 8, wherein said side frames permit mounting of the piece of furniture onto said support arrangement, each of said side frames operative to support the piece of furniture at its upper end.

10. A piece of furniture comprising:

a support arrangement;

a rocking mechanism including:

a unitary front link having an upper end adapted to be pivotally mounted to said support arrangement and having a lower end that defines an elongated bottom front bearing member;

a unitary rear link having an upper end adapted to be pivotally mounted to said support arrangement and having a lower end that defines an elongated bottom rear bearing member; and first and second lower links, each of said lower links having a front end and a rear end respectively, the front end of said first link and the front end of said second link being pivotally mounted to said bottom front bearing member about a pivot axis that extends along said front bearing member, said bottom front bearing member extending substantially continuously from the front end of said first lower link to the front end of said second lower link;

an adapter member for mounting the piece of furniture onto said support arrangement, said adapter member permitting rocking of the piece of furniture relative to said support arrangement.

11. A piece of furniture as defined in claim 10, wherein said support arrangement comprises a substantially vertical post with a spreader frame mounted thereon, said spreader frame having first and second ends.

12. A piece of furniture as defined in claim 11, wherein the first end of said spreader frame is pivotally connected to the upper end of said unitary front link, and the second end of said spreader frame is pivotally connected to the upper end of said unitary rear link.

13. A piece of furniture as defined in claim 12, wherein each of said first and second lower links is of a lesser length than said spreader frame.

14. A piece of furniture as defined in claim 13, wherein said support arrangement further comprises a broad base for supporting said substantially vertical post.

15. A piece of furniture as defined in claim 11, wherein said support arrangement further comprises a swivel mechanism interposed between said vertical post and said spreader frame.

16. A piece of furniture as defined in claim 10, wherein said support arrangement comprises a set of spaced-apart, arched feet members, each foot member having a raised, central portion to which are connected said unitary front and rear links.

17. A piece of furniture as defined in claim 10, wherein said adapter member is substantially centrally disposed with respect to said support arrangement.

18. A piece of furniture as defined in claim 10, where said adapter member is a first adapter member, said piece of furniture further comprising a second adapter member, said first and second adapter members being in a spaced-apart relationship, disposed substantially adjacent said support arrangement.

19. A piece of furniture as defined in claim 10, wherein said piece of furniture further comprises a seating arrangement mounted on said adapter member.

20. A piece of furniture as defined in claim 19, further comprising a swivel mechanism interposed between said rocking mechanism and said seating arrangement.

21. A piece of furniture as defined in claim 10, wherein a cradle is mounted on adapter member.

22. A piece of furniture as defined in claim 10, wherein a baby bed is mounted on said adapter member.

23. A piece of furniture as defined in claim 10, wherein a baby seat is mounted on said adapter member.

24. A piece of furniture as defined in claim 10, wherein a footrest is mounted on said adapter member.

25. A piece of furniture as defined in claim 10, wherein a chair is mounted on said adapter member.

26. A piece of furniture as defined in claim 10, wherein a sofa is mounted on said adapter member.

* * * * *